United States Patent [19]

Herd

[11] 4,129,238

[45] Dec. 12, 1978

[54] APPARATUS FOR FEEDING A WEB IN REGISTRY BETWEEN WEB PASSES THROUGH A PROCESSING MACHINE

[75] Inventor: Josef Herd, Münster b. Dieburg, Fed. Rep. of Germany

[73] Assignee: Maschinenfabrik GOEBEL GmbH, Fed. Rep. of Germany

[21] Appl. No.: 832,983

[22] Filed: Sep. 13, 1977

[30] Foreign Application Priority Data

Sep. 21, 1976 [DE] Fed. Rep. of Germany ..... 2642381

[51] Int. Cl.[2] ..... B65H 23/18

[52] U.S. Cl. ..... 226/29; 226/44; 242/75.43

[58] Field of Search ..... 226/44, 25, 28, 29, 226/38, 39; 242/75.3, 75.42, 75.43, 75.44

[56] References Cited

U.S. PATENT DOCUMENTS

| | | | |
|---|---|---|---|
| 2,586,286 | 2/1952 | Andreas | 226/44 |
| 3,025,791 | 3/1962 | Auerbacher | 226/2 X |
| 3,083,602 | 4/1963 | Obenshain | 242/75.43 X |

*Primary Examiner*—Richard A. Schacher

*Attorney, Agent, or Firm*—Watson, Cole, Grindle & Watson

[57] ABSTRACT

An apparatus is disclosed for use with machine processing equipment for processing a continuous moving web having markings representing repeat lengths applied thereto during a prior web pass through the machine. The apparatus insures registry of the web between passes through the machine as it is capable of varying web tension maintained downstream and upstream of a web draw mechanism in accordance with the changes in speed and elongation of the web prior to entering the machine.

4 Claims, 1 Drawing Figure

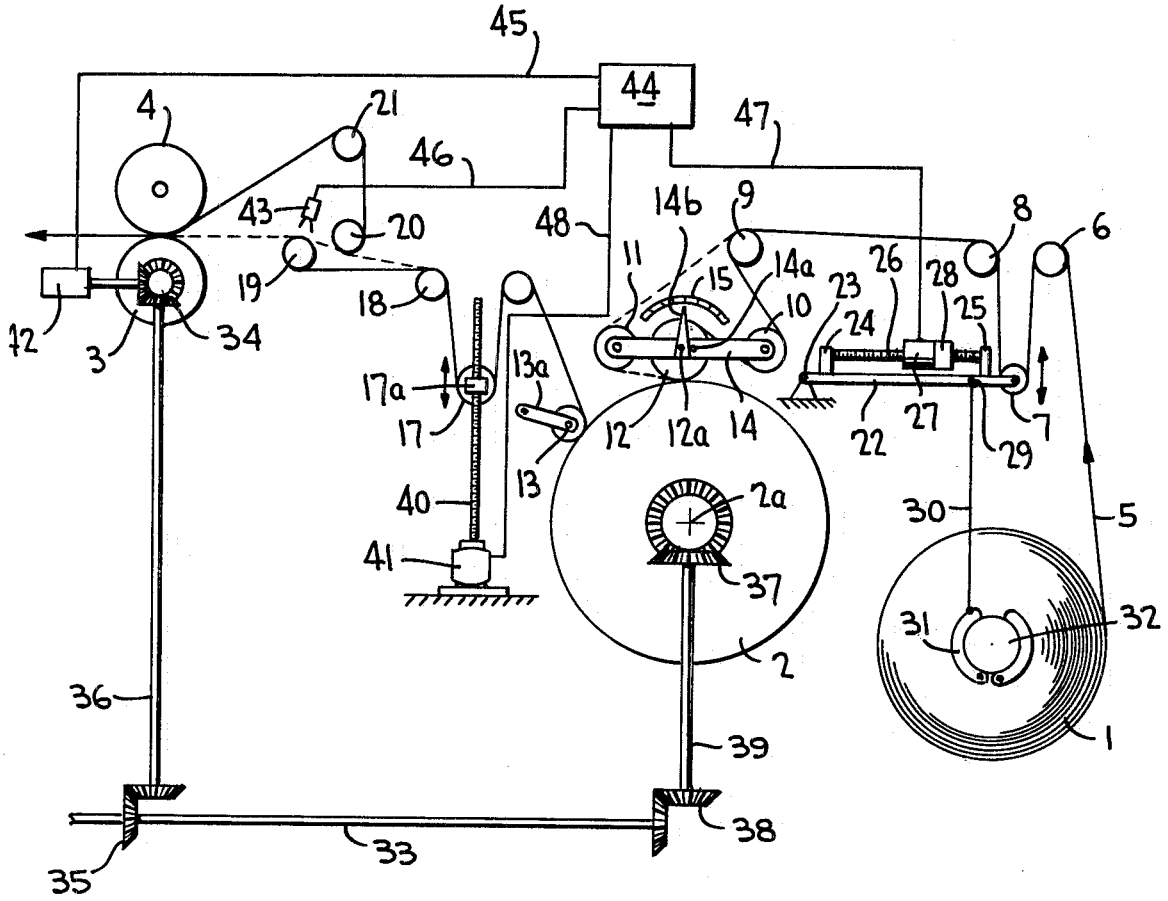
45
44
4
21
47
46
43
20
48
14b
9
8
6
19
18
11
15
14a
26
28
23
10
24
25
12
3
34
17a
13a
12
12a
14
22
27
7
17
13
29
40
2a
30
5
41
37
31
32
2
36
39
1
38
35
33

APPARATUS FOR FEEDING A WEB IN REGISTRY BETWEEN WEB PASSES THROUGH A PROCESSING MACHINE

BACKGROUND OF THE INVENTION

This invention relates generally to a web feeding apparatus, and more particularly to an apparatus for applying variable web tension to the web for effecting web registry between web passes through a web processing machine.

Arrangements are known for the feeding of the web receiving multiple operations which are required to be in registration. A typical example is multi-color printing, or scoring, creasing, punching and cutting of the web already printed, thus requiring a "print-to-print" register or a "cut-to-print" register. Between the first processing operation of the web, such as printing, and a subsequent processing operation, the web is normally wound into a roll and thereafter unwound as it is again fed through the web processing machine. Care must be taken in maintaining registration between web passes so that the subsequent printing operation, for example, does not interfere with the print already applied to the web during its first pass through the machine. It becomes particularly difficult to maintain such registration for webs of paper, foil, fabric and the like which stretch to various extents therealong depending on the moisture content. Also, during production, the webs may be rendered non-homogenous thereby causing the web to yield to variable extents when subjected to a uniform tension. Moreover, repeat lengths applied along the web must typically be precisely controlled relative to each other.

U.S. Pat. No. 3,025,791 discloses a technique for effecting variable web tension as the web is scanned during its passage through a multi-color press, as well as detecting the phase of the plate cylinders of the printing machines. An adjustable dancer roll is provided for applying a maintained tension to the web between a web pull unit and the first of the web processing machines. A controllable weight element is provided for varying the adjustment of the dancer roll, and control circuitry responsive to a device which scans markings applied to the web operates the weight element for varying the tension applied to the web ahead of the machines. However, such an arrangement is not readily conducive for controlling registration of a previously printed web temporarily rewound and again fed through the printer. Moreover, such an arrangement does not make provision for a clear separation of the total stretch of the web as well as for variable stretches along the length of the web.

In French Pat. No. 1,525,118 a pair of dancer rolls for applying tension to the web is disclosed as located respectively between the print couple and the web draw mechanism and between the draw mechanism and the web supply roll. The latter dancer roll is, however, utilized for braking the unwound web, while the other dancer roll is provided for controlling the r.p.m. of the draw mechanism. Web tension as it passes through the machine is, therefore, influenced by the control of both dancer rolls except that no provision is made for controlling both the total web tension as well as changes in web tension along the web. Hence, such an arrangement is not readily adaptable for registering a preceding web processing operation with a succeeding web processing operation.

In German Pat. No. 563,554 both a dancer roll as well as an adjustable guide roll are disclosed for controlling the tension of the web fed through a web processing machine. However, existing markings on the web are not scanned and compared during a succeeding web processing operation. Moreover, since the rolls are not interrelated, this arrangement is not suitable for use in processing thin webs, especially those running at high speeds, since webs are apt to tear easily. Besides, this arrangement includes multiple parts cooperating mechanically and coupled together thereby affecting the precision thereof.

In German Pat. No. 615,035, an arrangement is disclosed wherein registration is controlled by the scanning of the markings on the web to be processed and, if deviations from a set value of web stretch occur, corresponding corrections in web tension are made by changing the speed of the draw mechanism and by simultaneously adjusting a tension roll. By controlling the speed of the draw mechanism, web tension is altered during its subsequent passage through the web processing equipment, except that the precision with which the arrangement operates is insufficient for present day requirements since no provision is made for controlling variable web tension.

SUMMARY OF THE INVENTION

It is an object of the present invention to provide an apparatus for use with a machine processing a continuous moving web having markings representing repeat lengths applied thereto during a prior web pass through the machine, the apparatus permitting web registration for a fed web undergoing subsequent processing operations.

The apparatus according to the invention includes a web drawing mechanism disposed between the web processing machine and a rewound web roll, and an adjustable dancer roll for applying a maintained tension to the web upstream of the draw mechanism being connected to a braking device coupled with the rewound roll for establishing a direct relationship between a decrease (or increase) in web tension and an increase (or decrease) in braking effect on the web as it is unwound. The draw mechanism is operatively connected to the drive provided for the web processing machine, and the dancer roll has a remotely controllable means thereon for varying its adjustment so as to vary the maintained web tension. An adjustment guide roll is disposed between the web processing machine and the draw mechanism, and has remotely controllable means thereon for varying its adjustment so as to vary the maintained web tension. The controllable means provided for the dancer roll and the guide roll are independent of one another but are controlled in response to a scanner which scans the markings previously applied to the web so as to vary the maintained tension applied to the web both downstream and upstream of the draw mechanism.

A constant drive ratio is maintained between the driven processing machine and the draw mechanism. And, another scanning device is provided for measuring the speed of the web movement, control circuitry being responsive to the scanners for operating the remotely controllable means on the dancer roll and the guide roll for varying the maintained tension to the web both downstream and upstream of the draw mechanism in an appropriate direction to maintain registry of the web during passes through the web processing machine. The draw mechanism includes a rotatable drum in engagement with the web, and a pair of pressure rolls mounted for movement into contact with and out of contact away from the drum so that the web may be fed respectively by the drum together with the pressure rolls or by the drum itself.

In accordance with such an arrangement, tension is applied to the web upstream of the press line and downstream of the draw mechanism, and is further applied upstream of the draw mechanism, in dependence upon the speed of the web and the variable yield of the moving web. The web is therefore subjected to the same variable stretching therealong between, for example, a first pass through the machine and a second pass therethrough, so that web registry may be maintained between web passes through the web processing machine. And, in the event of a constant stretch of the web any lateral shifting of the web will be avoided with the present arrangement.

BRIEF DESCRIPTION OF THE DRAWING

The single drawing schematically illustrates the arrangement according to the invention, with those parts not essential to the invention being omitted for the sake of clarity.

DETAILED DESCRIPTION OF THE INVENTION

Turning now to the drawing wherein like reference characters refer to like and corresponding parts throughout the single drawing FIGURE, the apparatus includes a frame (not shown) and a roll 1 journaled on the frame, such a roll depicting the web as rewound after having passed through a web processing machine. During such a previous pass the web will have been imprinted with repeat markings which may be special markings or may be constituted by an edge of the printed matter applied to the web. Such markings may alternatively be constituted by punch holes or cuts applied to the web at regular intervals comprising repeat lengths therealong.

The apparatus further includes a draw drum 2 journaled on the frame for rotation about its central axis. A web processing machine in the form of a printing unit is partially illustrated by a rotatably mounted plate cylinder 3 and a rotatably mounted pressure cylinder 4. The apparatus according to the invention may alternatively be utilized with a web processing machine including transverse cutting or perforating devices or punching devices, or some other arrangement provided in lieu of cylinders 3 and 4.

The continuous moving web, shown at 5, is unwound from roll 1 and is wound about a rotatable guide roll 6, an adjustable dancer roll 7, and about additional rotatable guide rolls 8, 9, 10 and 11, as well as about a pressure roll 12 having a rotation axis **12*a* laterally offset from rotation axis 2*a* of the drum. As will be seen, roll 12 is capable of being moved toward and away from the drum. Also it should be noted that rolls 6, 8, 9** are journaled on the frame of the present apparatus for rotation about their central axes.

The pressure roll is disposed relative to the drum at a location wherein the web enters the draw mechanism, and another pressure roll 13 is disposed relative to the drum at a location wherein the web exits the draw mechanism. The draw mechanism, therefore, includes the drum and pressure rolls 12 and 13, with roll 13 being rotatably mounted on an arm **13*a* pivotally mounted to the frame for movement of roll 13 toward and away from the drum. The web is, therefore, pressed against the drum not only as a result of its inherent tension, but also with the assistance of pressure roll 12 and/or pressure roll 13. Accordingly, any slippage between the web and the draw drum is substantially avoided, and a speed of the web equal to the peripheral speed of the draw drum is substantially assured. Additional pressure rolls (not shown) may be provided in peripheral contact with the draw drum between rolls 12 and 13** in the direction of web movement (see the arrows on the web).

Pressure rolls 12 and 13 are mounted in place in such a manner that web 5 is clamped between them and draw drum 2. Guide rolls 10 and 11 are rotatably mounted at opposite ends of a rocker arm 14 which is mounted on the frame for pivotal movement about an axis **14*a* substantially in vertical alignment with rotation axis 2*a*. Depending on the particular type of web 5, rocker arm 14 may be pivoted about its axis and, because the rotational axes 2*a* and 12*a* are laterally offset, pivotal movement of the rocker arm about its axis 14*a* causes pressure roll 12 to be moved toward and away from the drum. A pointer 14*b* on the rocker arm 14 registers with a scale 15 provided on some portion of the frame for indicating the degree of rocker arm movement and accordingly the degree of pressure intended between roll 12 and drum 2. Such a pivotal adjustment of the rocker arm would need to be manually made only once for each type of web material being processed. And, the adjustment would be made prior to the beginning of the processing operation, although it is also possible to adjust the pressure between roll 12 and the drum as the rocker arm is rotated about axis 14*a* during the operation of the present apparatus in order to correct the movement of the web through the processing machine. Also, pressure roll 13 may be manually adjusted depending on the particular type of web material being processed. And, it can be seen that web 5 may be guided over roll 9 toward pressure roll 12 via guide roll 10, along a path shown in solid outline, or via guide roll 11** along a path shown in broken outline.

Web 5, after leaving pressure roll 13, is guided about a guide roll 16, journaled for rotation on the frame, after which the web loops around an adjustable guide roll 17 and then runs toward the printing machine shown by plate cylinder 3 and printing cylinder 4, or toward some other treatment or processing arrangement via guide rolls 18, 19, 20 and 21 each rotatably journaled on the frame. Alternatively, the web may be extended toward the printing machine along a path illustrated in dotted outline between rolls 19 and 20 after leaving roll 18.

Dancer roll 7 is mounted on a rocker arm 22 mounted on the frame of the apparatus, as at 23, for vertical pivotal movement, shown by the double arrow associated with roll 7. Side guides (not shown) are typically provided for guiding the rocker arm during its vertical pivotal movement. And, bearings 24 and 25 are provided near opposite ends of the rocker arm for the reception of an externally threaded spindle rod 26. A small adjusting motor 27 is mounted on the spindle in threaded engagement therewith for movement therealong when actuated, and a weight 28 connected to motor 27 may be likewise provided for movement therewith. The tension of the web between roll 1 and drum 2 may be accordingly adjusted upon actuation of motor 27 to cause rocker arm 22 to be moved pivotally in a vertical direction. It should be pointed out that weight 28 may be omitted if the weight of the motor 27 is sufficient to cause vertical pivotal movement of the rocker arm.

Arm 22 is connected via a joint 29 to a rod system 30 which is operatively connected to a brake system coupled with roll 1 in any normal manner. Hence, the rod system is pivotally connected to a brake shoe 31 of the brake system so as to cause the brake shoe to follow the vertical movement of rocker arm 22. The brake shoe cooperates with a brake disc 32 connected to either the winding shaft on which the web is wound up into roll 1, or fixed rotatably with a clamping arrangement provided for roll 1. The arrangement for the mounting of roll 1, the brake shoe, the brake disc and rod system 30 are all parts of an unwinding arrangement for effecting the unwinding of the web as it proceeds toward the web processing machine. Dancer roll 17 is effectively connected to the braking device for establishing a direct relationship between a decrease in web tension and an increase in braking effect on the web. The direct relationship is likewise established between an increase in web tension and a decrease in braking effect on the web being unwound by the draw mechanism.

Plate cylinder 3 and draw drum 2 are driven together via a driven shaft 33, bevel gears 34 at the opposite ends of a shaft 36 respectively engaging a suitable gear on cylinder 3 and the bevel gear 35 provided at one end of shaft 33. Bevel gears 37 and 38, provided on opposite ends of a shaft 39, respectively engage a suitable gear on drum 2 and bevel gear 35 of shaft 33, as shown. No transmission change is provided for the gearing between cylinder 3 and the drum so that, during the running of the machine, the drive of the draw arrangement remains at a constant ratio with the drive of the plate cylinder.

Guide roll 17 is mounted for rotation on an internally threaded collar 17*a* which is in threaded engagement with an externally threaded elongated spindle 40. This spindle is fixed on motor element engageable with another small adjusting motor 41 for rotation of such element. Motor 41 is otherwise affixed to the apparatus frame. Therefore, upon actuation of motor 41, spindle 40 is rotated about its central axis for effecting up and down movement of roll 17, as shown by the double arrows associated therewith.

A phase detector 42 is operatively connected to plate cylinder 3 in a rotatable manner for determining the rotational position of the plate cylinder as well as the r.p.m. thereof and thus the speed of the web passing through the nip between cylinders 3 and 4. The construction and operation of this phase detector is generally known in the art and will therefore not be described in detail here.

Phase detector 42 is, in effect, a scanning instrument, and another scanning instrument in the form of a photoelectric cell 43 is fixedly mounted on the apparatus frame for scanning the markings already applied to the web during the prior web processing operation. A comparison arrangement in the form of suitable control circuitry is housed at 44, and scanners 42 and 43 are respectively connected to control circuitry 44 (of known construction and operation) as indicated by dashed-dot lines 45 and 46. Hence, the messages as reported from photoelectric cell 43 and from measuring device 42, i.e., the repeated passage of the markings on the web and the running speed of the processing machine as well as the pertinent phase position of cylinder 3, are compared with one another in the switching and control arrangement 44.

In the event of deviations of the distances between the web markings as, for example, because of a stretching, shrinking or a change in tension of the web, corresponding adjustment commands are sent from control circuitry 44 to motors 27 and 41 via electric lines illustrated schematically by dashed-dot lines 47 and 48. As motor 27 and weight 28, or motor 27 alone if no weight is used, are caused to be shifted along spindle 26, a different tension and thus a different stretch is induced into the web. And, upon actuation of motor 41 causing spindle 40 to rotate so as to thereby shift roll 17 along the axis of spindle 40, a change in the length of the web as it might occur as a result of a change in the load caused by the adjusted roll 17, is compensated, so that no relative shifting will result between the imprint already applied to the web and the imprint that is to be subsequently applied as the web passes through the printing mechanism. And, since the draw mechanism, which includes the draw drum, guide rolls 12 and 13 as well as guide rolls 10 and 11, is disposed in the running direction of the web between dancer roll 7 and adjustable guide roll 17, provision has been made that neither of these adjustment features will not be influenced by one another. Adjustable roll 17 is therefore applying a maintained tension to the web downstream of the draw mechanism. And, since separate and independent remote control motors are provided for respectively varying the adjustment of guide roll 17 and of dancer roll 7 for varying the maintained tension respectively applied downstream and upstream of the draw mechanism, the two adjusting arrangements of the invention are mechanically independent of one another.

Since photoelectric cell 43, disposed in the running direction of the web between adjustable guide roll 17 and the printing mechanism, is provided for observing web markings any variations in distance between markings are scanned prior to entry of the web into the web processing equipment. And, as a result of the independent adjustment of dancer roll 7 and guide roll 17, the web markings will be maintained spaced apart during the entire passage of the web through the web processing machine the same distances between first and second and subsequent passes therethrough. Registry between indicia applied to the web during its first pass and indicia or other operations applied during its second and subsequent passes, is therefore maintained.

Measuring device 42 constitutes a first scanning arrangement determining the phase position of cylinder 3, and photoelectric cell 43 constitutes a second scanning arrangement for determining the pertinent position of the web.

Motor 27 and weight 28 constitute a first arrangement adjusting the load of dancer roll 7, and motor 41 and spindle 40 constitute a second arrangement adjusting the position of guide roll 17.

Since web 5, after leaving guide roll 18, may be run either about guide roll 19 along a path shown in solid outline, or adjacent rolls 19 and 20 along a path shown in broken outline, photoelectric cell 43 may scan either side of the web depending on the path it takes after leaving roll 18. Accordingly, it is possible, when desired, to locate the imprint on one side of the web in registry with sufficient precision relative to an imprint applied to the same side, or the imprint may be located on one side of the web and aligned with an imprint applied to the other side thereof. Regardless of the type of markings it is essential that the web during its passage through the processing machine be subjected to the same stretch at a given place as during a prior passage through the machine so that the requirements for precision will be satisfied. In accordance with the invention, the spacing of the web markings as they existed during a prior pass of the web through the processing machine are precisely maintained for the web making another pass through the same processing equipment or through other web processing machines. Web operations are therefore maintained in precise registry regardless of the number of passes of the web through the same processing equipment or through different processing machines.

Obviously, many modifications and variations of the invention are made possible in the light of the above teachings. It is therefore to be understood that within the scope of the appended claims the invention may be practiced otherwise than as specifically described.

I claim:

1. Apparatus for use with a machine processing a continuous moving web having markings representing repeat lengths applied thereto during a prior web pass through the machine, a draw mechanism for unwinding the web from a wound roll, an adjustable guide roll for applying a maintained tension to the web downstream of the draw mechanism relative to web movement, the apparatus comprising: a braking device coupled to the wound roll for braking the web upon unwinding by the draw mechanism; an adjustable dancer roll for applying a maintained tension to the web upstream of the draw mechanism; the dancer roll being connected to the braking device for establishing a direct relationship between a decrease and increase in web tension, upstream of the draw mechanism, and an increase and decrease in braking effect on the web being unwound by the draw mechanism; drive means for operating the machine as well as the draw mechanism; means for scanning the speed of the web movement and for scanning the web markings between the adjustable guide roll and the machine for measuring any elongation of the web by the relative positions of the markings; first and second remotely controllable and independent means for respectively varying the adjustment of the guide roll and of the dancer roll for varying the maintained tension respectively applied downstream and upstream of the draw mechanism; and means responsive to the scanning means for operating the first and second remotely controllable means for varying the maintained tension to the web both downstream and upstream of the draw mechanism in an appropriate direction to maintain registry of the web during passes thereof through the machine.

2. The apparatus according to claim 1, wherein the drive means is coupled with the machine and the draw mechanism for operating them at a constant drive ratio.

3. The apparatus according to claim 1, wherein the machine includes a rotatable cylinder, and the scanning means includes a first scanning device for registering a phase position of the cylinder and a second scanning device for scanning the web markings.

4. The apparatus according to claim 1, wherein the draw mechanism includes a rotatable drum in engagement with the web, and a pair of pressure rolls mounted for movement into contact with and away from the drum so that the web may be fed respectively by the drum together with the pressure rolls or by the drum itself.

* * * * *